US009183721B2

(12) United States Patent
Mock et al.

(10) Patent No.: US 9,183,721 B2
(45) Date of Patent: Nov. 10, 2015

(54) DEVICE AND METHOD FOR MONITORING A PERSON IN WATER

(75) Inventors: Markus Mock, Uster (CH); Heinz Ruchti, Leutwil (CH)

(73) Assignee: BluArc Finance AG, Stalden (CH)

( * ) Notice: Subject to any disclaimer, the term of this patent is extended or adjusted under 35 U.S.C. 154(b) by 886 days.

(21) Appl. No.: 13/122,924

(22) PCT Filed: Oct. 5, 2009

(86) PCT No.: PCT/EP2009/007105
§ 371 (c)(1),
(2), (4) Date: Nov. 29, 2011

(87) PCT Pub. No.: WO2010/040487
PCT Pub. Date: Apr. 15, 2010

(65) Prior Publication Data

US 2012/0062377 A1 Mar. 15, 2012

(30) Foreign Application Priority Data

Oct. 6, 2008 (DE) ..... 10 2008 050 558

(51) Int. Cl.
*G08B 1/08* (2006.01)
*G08B 21/08* (2006.01)

(52) U.S. Cl.
CPC ..... *G08B 21/088* (2013.01)

(58) Field of Classification Search
None
See application file for complete search history.

(56) References Cited

U.S. PATENT DOCUMENTS

| | | | | |
|---|---|---|---|---|
| 4,305,143 | A * | 12/1981 | Simms et al. | 367/134 |
| 4,549,169 | A * | 10/1985 | Moura et al. | 340/539.26 |
| 4,747,085 | A * | 5/1988 | Dunegan et al. | 367/93 |
| 4,813,025 | A | 3/1989 | Rowland et al. | |
| 5,091,714 | A * | 2/1992 | de Solminihac | 340/573.6 |
| 5,408,238 | A * | 4/1995 | Smith | 342/357.55 |
| 5,959,534 | A * | 9/1999 | Campbell et al. | 340/573.6 |
| 6,154,140 | A * | 11/2000 | Thorpe et al. | 340/573.6 |
| 6,157,303 | A | 12/2000 | Bodie et al. | |
| 6,583,724 | B1 * | 6/2003 | Rodriguez | 340/573.6 |
| 7,714,709 | B1 * | 5/2010 | Daniel | 340/539.11 |
| 8,144,020 | B2 * | 3/2012 | Snyder et al. | 340/573.6 |
| 2003/0210147 | A1 | 11/2003 | Humbard | |
| 2003/0222782 | A1 * | 12/2003 | Gaudreau | 340/573.6 |
| 2006/0214805 | A1 | 9/2006 | Boujon | |
| 2006/0232429 | A1 | 10/2006 | Gonzalez | |
| 2007/0132578 | A1 * | 6/2007 | Powell | 340/539.26 |
| 2008/0174441 | A1 | 7/2008 | Durand et al. | |
| 2009/0295566 | A1 * | 12/2009 | Weintraub | 340/539.11 |
| 2013/0173033 | A1 * | 7/2013 | Oleson et al. | 700/91 |

FOREIGN PATENT DOCUMENTS

| | | | |
|---|---|---|---|
| DE | 10116000 | A1 | 10/2002 |
| EP | 1492069 | A1 | 12/2004 |
| GB | 2428850 | | 2/2007 |

* cited by examiner

*Primary Examiner* — Julie Lieu
(74) *Attorney, Agent, or Firm* — Greer, Burns & Crain, Ltd.

(57) ABSTRACT

A device is provided for monitoring waters, particularly swimming pools, including at least one control unit assigned to one person which includes at least one sensor device, one analysis device and one transmitter; at least one receiving device disposed within the waters; at least one transmission device which is signal-connected to the receiving device; and at least one display unit which is signal-connected to the transmitter. The transmitter is designed such that it emits signals of a predetermined pattern in the event of an alarm, and the receiving device is designed such that it recognizes a case of alarm based on the predetermined pattern of the signal and emits an alarm signal to at least one display unit.

21 Claims, 5 Drawing Sheets

DEVICE AND METHOD FOR MONITORING A PERSON IN WATER

BACKGROUND

A means and method for monitoring waters, particularly swimming pools, comprising control units assigned to persons to be monitored which emit signals at least in emergency situations and at least one receiving device connected to a display unit to display an alarm signal, as well as a method for actively and passively monitoring waters.

An estimated approximately 40,000 people drown each year in Europe in swimming accidents.

Swimmers who get into trouble are frequently able to get the attention of other bathers, for example by the movement of their arms in their attempts to stay above water. Yet it is likewise also possible for a swimmer to lose consciousness without being noticed by those around him. Normally, the unconscious swimmer will sink to the bottom out of the sight of the other bathers.

Starting from the loss of consciousness, the first step in drowning, an experienced helper has roughly two to three minutes to save someone who is drowning. Within this period of time, a drowning person will generally not suffer any long-term consequences from the accident. Should rescue occur between three and five minutes after consciousness has been lost, there is still a high chance of saving the drowning person. Beyond five minutes, the risk of death is very high.

Systems to monitor swimmers have previously not been widely adopted at beach areas nor in man-made swimming pools. One system is known from U.S. Pat. No. 5,091,714, for example, in which a swimmer wears a radio transmitter comprising a contact on his wrist which closes when his arm is submerged under water. If the arm remains underwater for a longer, predetermined period of time, an acoustic signal is emitted which is received by a hydrophone. It is difficult with this system to specify a length of time after which the swimmer needs to raise his arm above the water in order to prevent or stop the emitting of the acoustic signal, given for example swimmers of differing abilities or desires. Particularly with a plurality of swimmers, confusion can arise as to which transmitter sent the alarm signal. Hence, a certain interval of time can elapse before a continuous signal, and thus an emergency situation, is recognized. As a result, the time available for rescue operations is shortened.

In high-traffic areas such as swimming pools, it becomes more difficult for receivers to positively identify distress signals due to interference signals from various different sources. This is particularly true when a system uses transmitters which transmit their signals underwater to trigger alarms, audio signals being particularly well-suited for this purpose.

A monitoring system is known from DE 101 16 000 A1 in which a transmitter likewise disposed on the wrist of the swimmer continually emits sound waves outside of the range audible to human hearing. These sound waves are detected by receivers arranged above the surface of the water. Because of the density of water, the emitted sound waves become absorbed as the depth of the transmitter in the water increases. An alarm is triggered when the acoustic signal from a specific transmitter stops being received. Apart from the high amount of energy such systems use, they also require exacting placement of the receiver since as the horizontal distance of the transmitter from the receiver increases, even the signals from a transmitter at only a slight depth of water will be absorbed.

The known systems offer no possibility of preventing accidents by monitoring waters which people use illicitly, for example outside of actively-monitored periods, or into which people fall accidentally.

The present invention addresses the task of providing a means as well as a method for monitoring waters which overcomes the disadvantages of the known systems.

SUMMARY

The inventive means for monitoring waters, and in particular swimming pools, comprises at least one control unit assigned to one person. Such a control unit comprises at least one sensor device, one analysis device and one transmitter. The means further comprises at least one receiving device disposed within the waters, at least one transmission device which is signal-connected to the receiving device, and at least one display unit which is signal-connected to the transmission device. The transmitter is designed according to the invention such that it emits signals of a predetermined pattern in the event of an alarm. The receiving device identifies the inventive signal based on its predetermined pattern and transmits an alarm signal to at least one display unit.

A control unit worn on the wrist is used with the inventive means for actively monitoring bathers or other at-risk persons in the water such as small children. When the means is used in public pools, the control unit is preferably integrated into the locker key wristband as commonly used at such public facilities. Such a control unit comprises at least one sensor device which detects the parameters related to an emergency situation, one analysis device for ascertaining an alarm situation from the values detected by the sensor device, and one transmitter which emits alarm signals exhibiting a predetermined pattern when an alarm situation occurs.

Preferably, a plurality of parameters from the values detected by the sensor device are imported into an analysis device, likewise preferably disposed in the control unit. If the analysis device can ascertain an emergency situation from one of the detected values and/or a combination of detected values, it will then emit a signal indicating an emergency situation to the receiving device, likewise preferably disposed in the control unit.

In one preferred embodiment of the inventive means, the sensor device detects the prevailing pressure on the control unit over time as a relevant parameter. The sensor device preferably also detects wearer-related parameters such as for example movements of the control unit.

The control unit furthermore preferably comprises additional devices such as a display of the current battery status or devices at least not predominantly serving safety purposes. For example, these could be electronic key systems or cashless payment systems for which an RFID transponder or the like can preferably be integrated into the control unit. A display is preferably integrated into the control unit to display stored information related for example to the monitoring system or the payment function or to the battery status.

One preferred embodiment of the means encompasses a plurality of different control units which ascertain whether an emergency situation has arisen contingent upon the individual properties of a wearer given respectively different external conditions. This can relate for example to control units intended for small children, non-swimmers, general swimmers or serious swimmers. The analysis device of the control unit thereby determines an emergency situation to have arisen preferably as a function of a specific amount of time at which the control unit remains at a predetermined depth of water. Should the sensor device of the control unit also be able to detect its movement, a longer period of motionlessness can likewise be a criterion indicating an emergency situation.

For example, an emergency situation can be defined for a swimmer wearing the control unit on his wrist as an excess pressure of at least 0.1 bar lasting for longer than 45 seconds. An excess pressure of 0.1 bar prevails at a water depth of one meter. It is normally only possible for a swimmer wearing the control unit on his wrist to reach a depth of one meter or deeper underwater when the head of the swimmer is far below the surface of the water. Therefore, it is virtually impossible for the control unit to be subject to an excess pressure of 0.1 bar for any extended length of time in normal bathing situations. Although since such excess pressure can also arise momentarily during the course of a swimmer's normal swimming actions or also in the case of intentional dives, a distress signal preferably does not occur until this excess pressure prevails for a predetermined longer period of time not posing any danger to the bather. This period of time as well as the relevant excess pressure are preferably specified according to the characteristics of the individual bathers.

It is preferably possible to specify the parameters and their values defining an emergency situation for a control unit as a function of a person's physical characteristics or abilities. The control unit is preferably designed such that the values of a parameter defining an emergency situation can also be modified, for example by those operating the bathing facilities and/or the monitoring means.

When the analysis device detects an alarm situation, the transmission device emits a signal of a predetermined pattern. The defined pattern of the signal allows the receiving device to reliably and quickly identify the signal. The signal pattern is thereby preferably defined by signal pulses of a predetermined intensity and predetermined temporal sequence. The intensity of a signal pulse is thereby preferably at least high enough for it to stand out from the other signals in the area in its same frequency range and thus be reliably detected.

In order to exclude the triggering of a false alarm due to heavy interference signals in the frequency range used for the signal, according to the invention the signal exhibits a pattern which can be varied, at least in terms of intensity, the sequence of different signal intensities or also in terms of the intervals. It is likewise also possible to vary for example the temporal sequence of pulses of different intensities such that the predetermined pattern exhibits different preferably successive partial patterns which can for example take the form of pre-signal and main signal or can also be varied as a function of the emergency situation.

It is further possible to preferably provide the transmitted signal of a control unit with attributes such as e.g. an identifier for the purpose of allocating, respectively identifying individual control units.

In one preferred embodiment, the signal is transmitted by ultrasonic waves having a frequency in the range of from 20 to 600 kHz. A frequency range of from 20 to 100 kHz has been shown to be particularly suited hereto in terms of range and power consumption.

The monitoring function of the inventive control unit is preferably not activated until the control unit enters the water. This can be triggered for example by a contact switch on the control unit which activates the monitoring function as soon as the control unit is in the water.

In one preferred embodiment, the control unit is designed such that should it become separated from the swimmer, its monitoring function is switched to inactive and/or emits a disconnect signal. This can be triggered for example upon the absence of a contact signal or, in the case of a control unit in wristband form, for example by parting the wristband to open it. Such measures can prevent an unfounded alarm from being triggered due to inadvertently or intentionally losing the control unit. Having a disconnect signal be emitted offers the advantage of being able to immediately recognize that a swimmer is not wearing a control unit. As a result, steps can be taken to prevent a swimmer without a control unit from having an undetected accident.

One preferred embodiment of the control unit comprises a closure device on the wristband requiring for example an additional mechanism such as a fitted tool (key) or information such as e.g. a combination of numbers for its actuation. Such a mechanism can for example prevent small children from taking off the control unit.

The transmitter of the control unit of the inventive means for monitoring waters emits signals of predetermined pattern as soon as the analysis device detects an alarm situation. These signals are detected by at least one receiving device. One or more such receiving devices of the inventive means are preferably disposed in the swimming pool, respectively in the bathing area of a larger body of water, such that a signal emitted by the control unit can be received without interference regardless of the swimmer's whereabouts. A plurality of receiving devices are hereby preferably disposed in the case of larger swimming pools or along beaches.

The at least one receiving device of the means according to the invention is signal-connected to at least one transmission device which is preferably disposed at a location out of the water, preferably at water's edge along the shoreline or at the edge of a pool. The transmission device transmits alarm signals to at least one display unit. The means according to the invention can also be designed such that the transmission device forms a structural unit with a receiving device, a display unit or other further mechanisms. The mechanisms described in conjunction with the present invention such as the sensor device, analysis device, transmitter, receiving device, transmission device or display unit, etc. are not necessarily to be understood as structural units but rather as functional units.

In the context of the invention, signal-connected refers to at least two devices between which signals can be exchanged in at least one direction. The signals are thereby preferably bound to a medium such as an electrical conductor, for example. Signals between signal-connected units can also likewise can be transmitted without being directly bound to a conductive material, such as in particular by means of sound waves or electromagnetic waves (e.g. radio waves or infrared light).

In one preferred embodiment, the carrier frequency of the signal emitted by the control unit is selected so as to substantially minimize its absorption by the media between the control unit and the receiving device. Other carrier frequencies can however also be selected, for example the ISM frequencies available for commercial purposes free of charge.

In one preferred embodiment, the alarm signal is transmitted to a plurality of display units signal-connected to the transmission device such as e.g. portable hand-held devices, primarily acoustic or primarily visual display means or directly to a receiving device at a rescue center.

To be understood as a display unit in the context of the invention is any device capable of producing stimuli which can be perceived by human senses. Such stimuli are preferably visual stimuli displaying visually as e.g. lights or on screens and/or acoustic stimuli preferably produced by loudspeakers.

In one preferred embodiment particularly suited to smaller swimming pools and smaller beaches, the alarm is sent for example for a specific interval of time to the portable hand-held devices used by specific people, e.g. those responsible for monitoring the waters. The qualified personnel can then immediately check whether there is an actual emergency before other bathers are subjected to an alarm situation causing a possible further emergency.

In a further preferred embodiment, the transmission device only transmits the alarm signal to the portable hand-held device of a supervisor who for example after making a quick general assessment of the emergency, preferably takes the further immediate measures at his disposal via the hand-held device such as warning the rescue personnel.

Apart from the above-described use of actively monitoring bathing waters, the means according to the invention can preferably also be operated in a second, passive monitoring mode. This mode is preferably suited for monitoring standing bodies of waters which are largely motionless such as for example closed swimming pools or even garden ponds or industrial waters such as reservoirs.

For this type of use, the receiver is preferably set such that it will emit an alarm signal to at least one transmission device, and thus to at least one display unit, when it receives signals indicating vigorous water movement. The alarm signal of a control unit can also preferably be recognized in the passive monitoring mode and a corresponding alarm signal preferably transmitted by the transmission device to a display unit as additional information. This function can be used for example by private users to monitor waters in areas in which children play or where other potentially vulnerable persons gather.

When objects, animals or unauthorized persons move within monitored waters, the receiving device detects such signals which would be disregarded in the active monitoring mode as interference signals based on the absence of a signal pattern or its low intensity. When the receiving device receives such signals in the passive mode, it emits an alarm signal to at least one display unit and preferably an additional or variant alarm signal when persons wearing a control unit, for example due to their vulnerability, such as non-swimmers or small children, fall into the monitored water and the receiving device detects signals of a predetermined pattern.

BRIEF DESCRIPTION OF THE DRAWINGS

The following description in conjunction with the drawings yields further advantages, features and conceivable applications of the present invention. Shown are.

DETAILED DESCRIPTION

Figure 1:
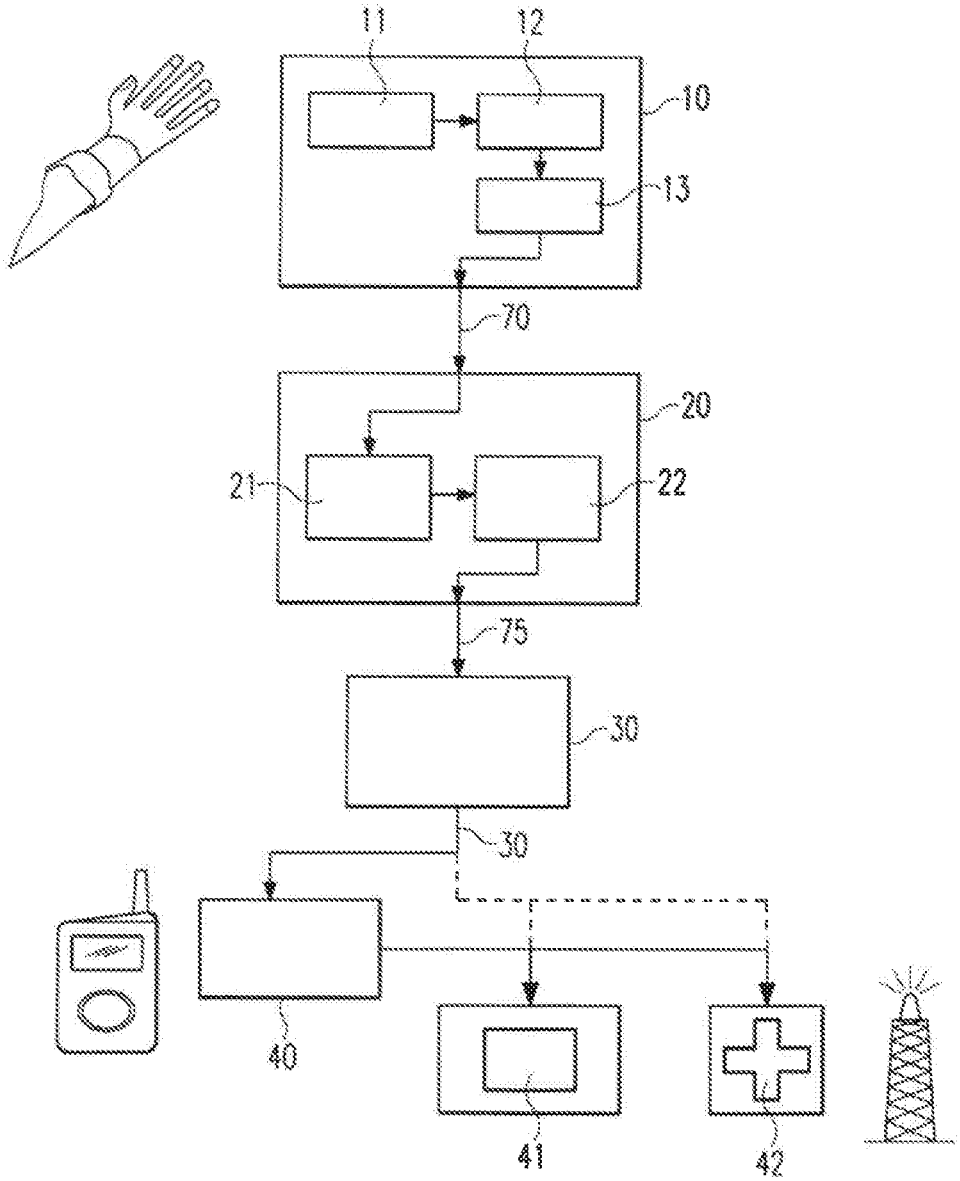
FIG. 1 a schematic representation of an exemplary embodiment of the present invention, FIG. 2 sample pattern of a signal emitted by the control unit according to the invention, FIG. 3 an exemplary embodiment of a control unit according to the invention, FIG. 4 a schematic representation of an exemplary application in a swimming pool, FIG. 5 a schematic representation of an exemplary application at a beach, and FIG. 6 a schematic representation of an exemplary portable application at a beach.

FIG. 1 shows a schematic representation of an exemplary embodiment of the means for monitoring waters which encompasses a control unit 10, a sensor device 11, an analysis device 12 as well as a transmission device 13. The sensor device 11 thereby comprises a sensor to detect the ambient pressure as well as motions of the control unit 10. The values for the recorded pressure and movement are imported to the analysis device 12.

The analysis device 12 checks whether the pressure value of the sensor device indicates that the control unit 10 is at a depth of e.g. at least one meter underwater for a predetermined period of time. Should the detected pressure value show that the control unit has remained at least one meter underwater for a predetermined period and for example no swimmer movement has been determined for a specific amount of time, the transmitter 13 is then activated to transmit a signal 70. The signal 70 exhibits a defined pattern enabling a reliable identification of the signal 70 in the receiver unit 20. Exemplary embodiments of signal 70 are specified in greater detail in conjunction with FIG. 2.

The receiving device 20 comprises a receiver unit 21 as well as a transmitter unit 22. The receiving device 20 receives the signal 70 emitted by control unit 10, can reliably identify it due to the pattern, and activates the transmitter unit 22 to transmit an alarm signal 75 to a transmission device 30. The transmission device 30 detects the signal 75 of the receiving device, converts it and transmits the alarm signal 80 in a suitable transmission format to at least one display unit 40. In one embodiment in which the control unit 10 transmits an identifier, the receiver unit 20 also transmits same to the display unit 40 via the transmission device 30.

The alarm signal 80 is transmitted to the display unit 40, for example a hand-held device. From there, an alarm signal can be sent to further display units 40, for example manually by being triggered by an operator or automatically, e.g. to acoustic and/or visual display means 41, or directly to an emergency center 42 to alert rescue personnel. It is however also likewise possible, as indicated by the dashed arrow, for the transmission device 80 to transmit alarm signals directly to a plurality of different display units 40, 41, 42.

Figure 2:
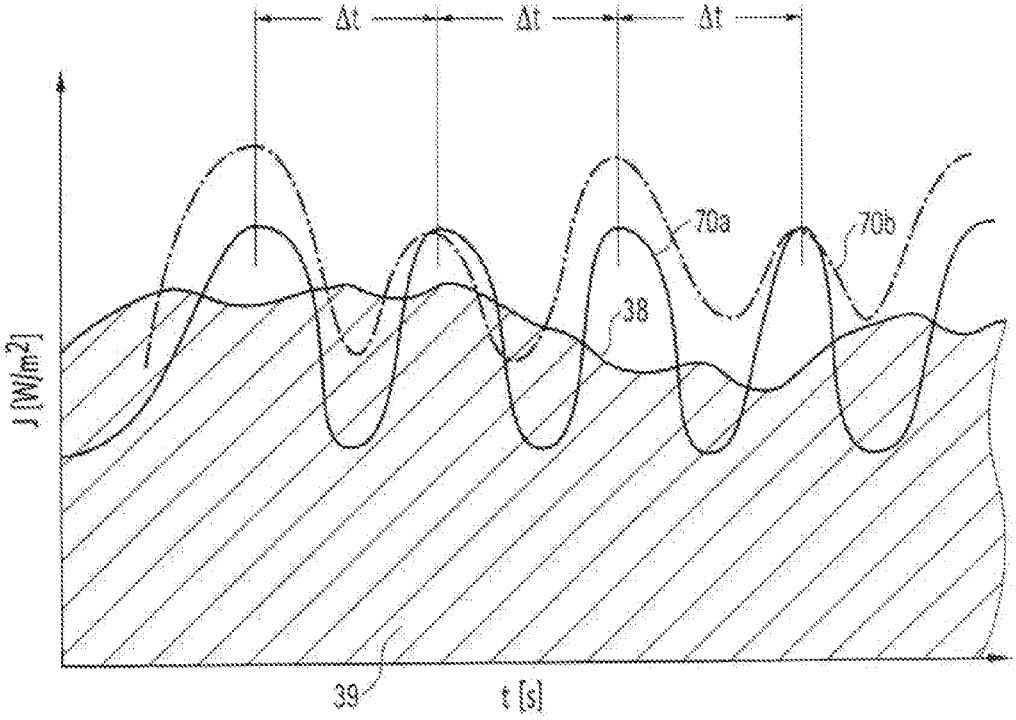

FIG. 2 shows two exemplary patterns for the signals 70*a*, 70*b* emitted by the control unit 10 in one time period. Line 38 thereby defines the progression of the mean maximum intensity J of the signals 39 in the frequency range of signal 70 within the operational area of the device.

The pattern of the first exemplary signal 70*a* is characterized by pulses of uniform intensity transmitted at regular intervals Δt. The intensity is thereby higher than the mean maximum intensity 38 of the environment. Not until the receiving device 20 has received multiple signal pulses of a predetermined intensity and within the intervals Δt of signal 70*a* is the signal 70 in the receiver unit 21 of receiving device 20 assessed as being reliably detected. Only then does the transmitter unit 22 transmit an alarm signal 75 to the transmission device 30 which then transmits to the at least one display unit 40. The repeated occurrence of interference signals at time intervals exhibiting a similar intensity as signal 70 during interval Δt is virtually impossible. This thus virtually eliminates the triggering of a false alarm due to extraneous signals.

FIG. 2 moreover shows a second exemplary signal 70*b* in which the intensity of the signal pulses varies. A stronger and a weaker pulse respectively alternate here in intervals Δt, wherein both signal intensities are higher than the mean maximum intensity 38 of the environment. Here, too, to the greatest possible extent, the pattern of the transmitted signal 70*b* enables reliable identification of signal 70 indicating an emergency regardless of interference signals.

Figure 3:
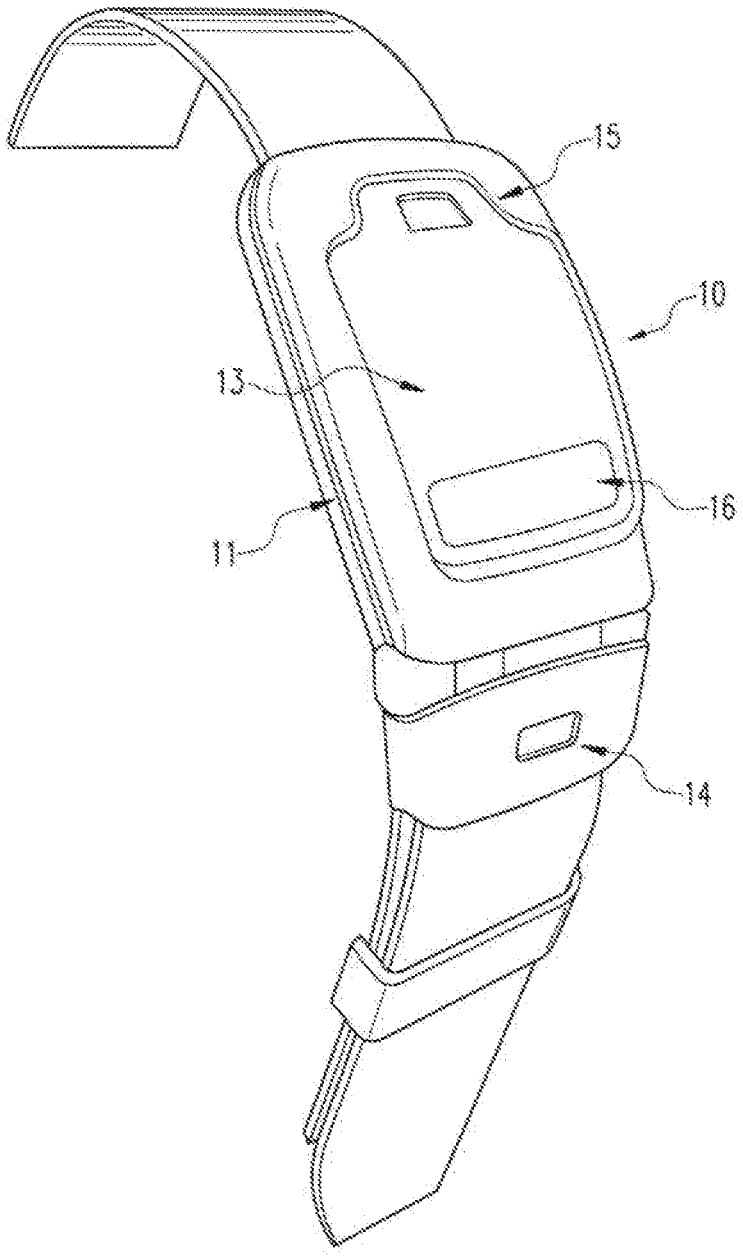

FIG. 3 shows an exemplary embodiment of the inventive control unit 10, configured in the form of a wristband worn on the wrist of the bather. The exemplarily depicted wristband, e.g. suitable for small children, comprises a closure device 14 actuatable or unlockable by a fitted tool such that the closure device prevents loss or removal of the control unit 10 without inserting the fitted tool in the closure device to unlock the closure device and release the wristband. Alternatively, a contact can also be disposed on the catch of the wristband, whereby the control unit 10 transmits a disconnection signal when same is interrupted to enable the wristband to be released and removed.

The sensor device 11 is disposed within the housing of control unit 10 and comprises at least one pressure sensor in direct communication with the environment and, in the exemplary embodiment, additionally comprises a motion sensor. An exposed and largely unobscurable transmitter 13 is arranged on the top side of the housing which in an emergency, emits an ultrasound signal as signal 70. An analysis device 12 (not shown) is further disposed within the housing of control unit 10, which derives an alarm situation event based on the values detected by the sensor device 11. A warning light 15 is arranged on a side of the housing which facilitates locating the control unit 10 sending an alarm signal 70 and thus the person in trouble. A battery indicator can for example be integrated into this warning light 15 to enable timely recognition of low battery and thus avoid failure in the event of emergency due to lack of power.

The battery status can additionally be continuously displayed on the display 16 arranged on the exterior of control unit 10, for example by means of a conventional battery status symbol, so that each user can also check the control unit's functional status themselves. This display 16 moreover serves to display other information such as for example the account status of a cashless payment system or a locker number.

Embodiments which use different parameters or the reaching of different values and/or combinations of values to determine an emergency situation can be distinguished by different realizations such as different color schemes, for example.

Figure 4:
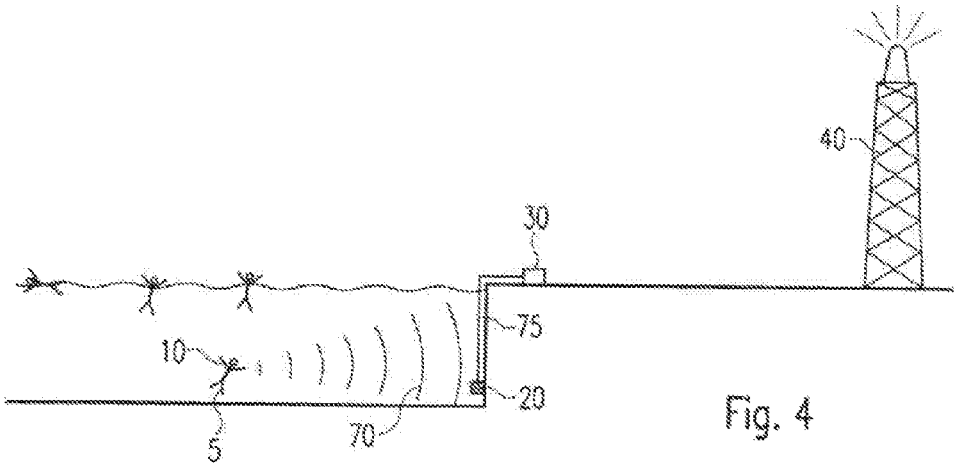

FIG. 4 shows a schematic representation of a first use of the inventive means in a swimming pool. Every swimmer 5 wears a control unit 10 on their wrist. The control unit 10 emits signal 70 in an emergency. At least one receiving device 20, affixed to the edge of the pool, reliably detects this signal 70 due to its pattern. The receiving device 20 transmits a distress signal 75 to the transmission device 30 which relays it to a display unit 40, e.g. also in the form of a hand-held device. Same displays that an emergency situation has arisen and leads to the triggering of an alarm.

Figure 5:
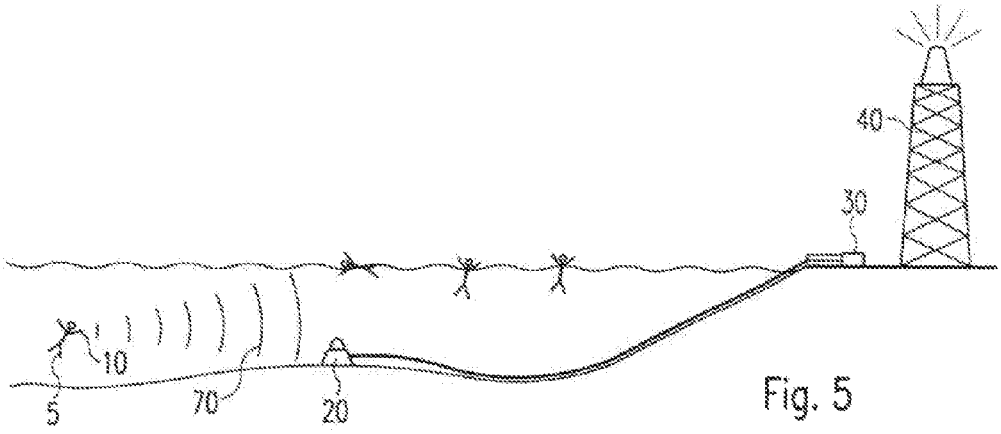

FIG. 5 shows a schematic representation of a second example of use of the inventive means at the beach. In this embodiment, one or more receiving devices 20 are firmly anchored to the ocean floor in the area of the shore. The receiving device(s) 20 is/are thereby arranged such that regardless of the position of the swimmer within the beach area, it is possible for at least one receiving device 20 to receive the signals 70 of the control unit 10. The receiving devices 20 relay their information to the transmission device 30 which activates the display unit 40, e.g. also in the form of a hand-held device, via a distress signal 80 and thus triggers an alarm.

Figure 6:
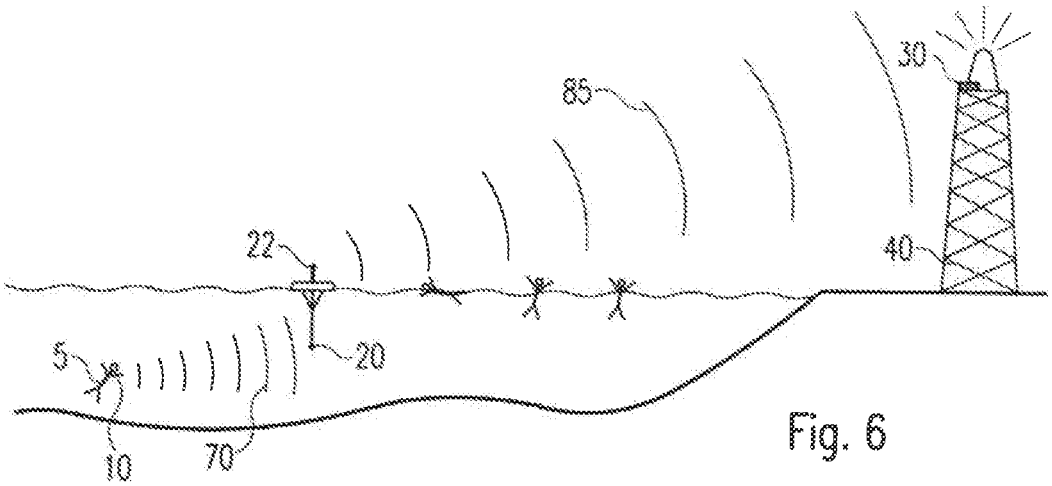

FIG. 6 shows a schematic representation for portable use of the inventive means at the beach. In this application, which is incidentally of analogous design to the means in FIG. 5, the at least one receiving station 20 is not firmly anchored to the ocean floor but rather firmly affixed underwater to a buoy.

In one embodiment of portable use exemplarily depicted in FIG. 6, the transmitter 22 is designed such that it transmits signals 85 through the air to a transmission device 30. This simplifies the mobile arrangement of receiver units in a body of water and prevents possible danger from a signal line running on the ground.

The invention claimed is:

1. A means for monitoring waters comprising:

at least one control unit assigned to one person which comprises at least one sensor device, one analysis device and one transmitter, at least one receiving device disposed within the waters at a designated location, wherein a carrier frequency of a signal emitted by the control unit is selected so as to substantially minimize its absorption by the media between the control unit and the receiving device at the designated location, at least one transmission device which is signal connected to the receiving device, and at least one display unit which is signal connected to the transmitter, wherein the transmitter is designed such that it emits a signal of a predetermined pattern in the event of an alarm, and the receiving device is designed such that it recognizes the alarm based on said predetermined pattern of the signal and emits an alarm signal to said at least one display unit.

2. The means according to claim 1, wherein the predetermined pattern of the signal is defined by a succession of signal pulses of a predetermined intensity and predetermined temporal sequence.

3. The means according to claim 2, wherein the control unit comprises an identifier which is transmitted with the signal to at least one display unit.

4. The means according to claim 1, wherein the transmitter of the control unit transmits signals by ultrasonic waves at a frequency range of from 20 to 600 kHz and particularly at a frequency range of from 20 to 100 kHz.

5. The means according to claim 1, wherein the transmitter of the control unit transmits a signal when the analysis device ascertains an emergency situation from one and/or a combination of values detected by the sensor device.

6. The means according to claim 5, wherein the values detected by the sensor device relate to the characteristics of the ambient pressure over time and/or motions of the control unit.

7. The means according to claim 1, wherein said means comprises various control units which derive an emergency based upon individual characteristics or abilities of defined groups of bathers or individual wearers.

8. The means according to claim 7, wherein the values of the parameters used to define an emergency can be modified.

9. The means according to claim 1, wherein the control unit is worn by bathers or vulnerable persons on their wrist.

10. The means according to claim 1, wherein an emergency situation is identified when a predetermined value is exceeded or undercut at the control unit for a predetermined length of time.

11. The means according to claim 1, wherein an emergency situation is identified when excess pressure on the control unit prevails beyond a predetermined length of time.

12. The means according to claim 1, wherein movement of the control unit is included as a criterion for the analysis device to detect an emergency situation.

13. The means according to claim 1, wherein the control unit comprises a closure device requiring a tool or input of information for its actuation.

14. The means according to claim 1, wherein the control unit is first activated as soon as it enters into the water.

15. The means according to claim 1, wherein the monitoring function of the control unit is switched to inactive and thereby emits a disconnect signal to the receiving device as soon as same becomes separated from the bather or not used in the intended way.

16. The means according to claim 1, wherein an alarm signal is transmitted to a portable hand-held device.

17. The means according to claim 1, wherein an alarm signal is directly or indirectly relayed to an emergency dispatch center.

18. The means according to claim 1, wherein the control unit further comprises additional devices not predominantly serving safety purposes.

19. The means according to claim 1, wherein said means is operated in a passive monitoring mode in which the receiving device detects signals indicating water motion and upon a fixed intensity threshold being exceeded, transmits a distress signal to the transmission device.

20. The means according to claim 19, wherein the receiving device also detects signals from a control unit in the passive monitoring mode and relays a distress signal to the transmission device analogously as in the active monitoring mode.

21. A means for monitoring waters comprising:

at least one control unit assigned to one person which comprises at least one sensor device, one analysis device and one transmitter, said control unit including a closure device requiring a tool or input of information to unlock the closure device and release the at least one control unit, at least one receiving device disposed within the waters, at a designated location, wherein a carrier frequency of a signal emitted by the control unit is selected so as to substantially minimize its absorption by the media between the control unit and the receiving device at the designated location, at least one transmission device which is signal-connected to the receiving device, and at least one display unit which is signal-connected to the transmitter, wherein the transmitter is designed such that it emits signals of a predetermined pattern in the event of an alarm, and the receiving device is designed such that it recognizes a case of alarm based on said predetermined pattern of the signal and emits an alarm signal to said at least one display unit.

* * * * *